United States Patent [19]

McCutchen

[11] Patent Number: 5,058,902

[45] Date of Patent: Oct. 22, 1991

[54] ELLIPSOIDAL FLARED RACQUET HANDLE WITH DISTAL BUTT WEIGHT

[76] Inventor: Wilmot H. McCutchen, P.O. Box 701129, Houston, Tex. 77270

[21] Appl. No.: 556,007

[22] Filed: Jul. 23, 1990

[51] Int. Cl.[5] ..... A63B 49/08; A63B 49/04

[52] U.S. Cl. ..... 273/73 J; 273/75

[58] Field of Search ..... 273/73 R, 73 J, 75, 273/81 R, 81 A, 80 R, 80 A

[56] References Cited

U.S. PATENT DOCUMENTS

| | | | |
|---|---|---|---|
| 3,545,755 | 12/1970 | Owada | 273/73 J |
| 3,833,219 | 9/1974 | Dean | 273/75 |
| 3,941,380 | 3/1976 | Lacoste | 273/73 J |
| 4,105,205 | 8/1978 | Theodores et al. | 273/73 J |
| 4,165,071 | 8/1979 | Frolow | 273/73 C |
| 4,183,528 | 1/1980 | An | 273/75 |
| 4,203,596 | 5/1980 | Nagamoto | 273/73 J |
| 4,349,199 | 9/1982 | Vulcano | 273/75 |
| 4,351,529 | 9/1982 | Schultz et al. | 273/75 |
| 4,355,803 | 10/1982 | Rama | 273/73 J |
| 4,374,589 | 2/1983 | Strickland | 273/75 |
| 4,438,925 | 3/1984 | Lindstrom | 273/75 |
| 4,470,599 | 9/1984 | Usher, Jr. | 273/75 |
| 4,549,736 | 10/1985 | Lofty | 273/73 J |
| 4,690,405 | 9/1987 | Frolow | 273/73 J |
| 4,693,475 | 9/1987 | Keilhau | 273/73 J |
| 4,732,384 | 3/1988 | Seymour | 273/73 J |
| 4,736,950 | 4/1988 | Doyle | 273/75 |
| 4,759,546 | 7/1988 | Steele, Jr. | 273/73 J |
| 4,811,947 | 3/1989 | Takatsuka et al. | 273/73 J |
| 4,828,261 | 5/1989 | Kleylein | 273/75 |
| 4,936,586 | 6/1990 | Van Raendonck | 273/73 J |

FOREIGN PATENT DOCUMENTS

| | | | |
|---|---|---|---|
| 0291576 | 11/1988 | European Pat. Off. | 273/73 J |
| 3628618 | 11/1987 | Fed. Rep. of Germany | 273/73 J |
| 2566670 | 1/1986 | France | 273/73 J |
| 2623092 | 5/1989 | France | 273/73 J |
| 0662110 | 5/1979 | U.S.S.R. | 273/73 C |
| 8701602 | 3/1987 | World Int. Prop. O. | 273/73 J |

*Primary Examiner*—Edward M. Coven
*Assistant Examiner*—Raleigh W. Chiu

[57] ABSTRACT

A racquet handle with an ellipsoidal cross-section, the long axis of which increases toward its distal end. Attached to the distal end of the handle is a metal weight, which extends the center of percussion, increases racquet head control, increases the power of heavily wristed shots, and neutralizes impact forces that may cause damage to a player's joints. The long ellipsoidal axis may be made radially adjustable about the longitudinal axis of the handle to suit the grip styles of individuals.

10 Claims, 3 Drawing Sheets

ELLIPSOIDAL FLARED RACQUET HANDLE WITH DISTAL BUTT WEIGHT

BACKGROUND

1. Field of the Invention

This invention relates to handles for sporting goods, specifically to tennis racquets.

2. Prior Art

Conventional tennis racquets have an octagonal handle whose longest faces are parallel to the racquet face. A plastic cap is at the butt of the handle, which makes the butt slightly wider than the rest of the handle. Because such a handle shape does not conform to the anatomy of the hand, but is purely arbitrary, the ulnar portion of the hand tends to slip off the end of the handle when the hand becomes wet, which has led to various grip coverings intended to reduce hand slippage.

The center of gravity in a conventional tennis racquet is located near the racquet face rather than near the hand of the player. The racquet is a cantilever. This distant weight, over time, tires the muscles of the player's wrist and forearm and aggravates the aforementioned problem with hand slippage. Moreover, the racquet is not as easy to position during fast play as it might be with the center of gravity closer to the player's hand. Recent improvements in racquet frame design have reduced the weight of the racquet head significantly, but this loss of mass necessarily entails a reduction of possible momentum. These light racquets are less powerful. Moreover, these light racquets transmit more shock from off-center ball impacts to the player's wrist and elbow, leading over time to tendonitis ("tennis elbow").

Despite numerous patented novelties in racquet design, none have succeeded in supplanting the conventional octagonal shape of the handle. Only insignificant adjustments have been made to the conventional location of the racquet's center of gravity. Light, rigid, head-heavy racquets with octagonal handles are the only marketed design.

1. ELLIPSOIDAL HANDLE SHAPE

U.S. Pat. No. 4,183,528 to An (1980), particularly FIG. 10 thereof, shows a partially ellipsoidal handle. The ellipsoidal portion, however, is not meant to engage the crook of the fingers but rather the thenar portion of the hand, as is clear from reference numerals 66*a* and 66*b*. The fingers in An's handle crook around an octagonal section.

U.S. Pat. No. 4,470,599 to Usher (1982) shows a racquet handle that is half-round and half-octagonal in cross-section. The round portion is meant to engage the thenar portion of the hand while the fingers crook around the octagonal portion.

U.S. Pat. No. 4,349,199 to Vulcano (1982) shows a non-ellipsoidal handle. However, one side of Vulcano's handle narrows to fit into the crook of the fingers.

U.S. Pat. No. 4,759,546 to Steele (1988), particularly FIGS. 12 and 13 thereof, shows a semi-ellipsoidal handle which in end view has one side round and one side ogive. The apparently ogive portion does not engage the crook of the fingers, however. The projection (100) at the tip of the handle which gives the racquet an ogive end view is meant to prevent longitudinal rather than radial motion of the handle. Cf. Column 10:48–52. The fingers grip a "variable generally octagonal cross-sectional shape." Col. 10:20–21. FIG. 9 illustrates the cross-section of Steele's handle where the fingers engage it, and this cross-section is definitely octagonal. Col. 10:26–31. If there were an actual, rather than merely apparent, ogive portion to Steele's handle, it would engage the crook of the fingers if Steele's handle is gripped in what he calls the "upslope" position. FIGS. 12 and 13. But Steele teaches a "downslope" position for the same handle, as illustrated in FIGS. 14 and 15, where it is the round side of the handle that engages the crook of the fingers. The transverse axis of this semi-ellipsoidal handle is in the plane of the racquet face. Steele's grip is of the offset, or pistol-grip variety.

U.S. Pat. No. 3,374,590 to Strickland (1983) shows a racquet handle having a cross-section consisting of a pair of parallel flat sides joined by arcs. The long axis of said cross-section is in the plane of the racquet face.

U.S. Pat. No. 4,828,261 to Kleylein (1989) discloses a racquet grip which may be of an ellipsoidal cross-section. The orientation of the ellipsoidal major axis to the racquet face is fixed in the plane of the racquet face. Kleylein's mention of an oval cross-section is not integral to his invention, and is only made in passing as an alternative to a circular cross-section. Col. 4:15–17.

2. FLARED HANDLE SHAPE

U.S. Pat. No. 4,549,736 to Lofty (1985) shows a handle which flares in the plane of the racquet face, with the cross-section of the handle rectangular throughout.

U.S. Pat. No. 4,183,528 to An (1980), particularly FIG. 8 thereof, shows an offset, gunstock-type racquet handle flaring in the plane of the racquet face. Only one half of the handle, which is the octagonal part, flares outward from the longitudinal axis of the handle.

U.S. Pat. No. 4,351,529 to Schultz (1980) shows a racquet handle which flares at the butt, outside the hand. Only half of the butt flares. The objective of this improvement is not to provide more security from radial movement but rather from longitudinal movement. Only the heel of the hand engages the flared portion of the handle.

U.S. Pat. No. 4,828,261 to Kleylein (1989) discloses a racquet grip with a "raised-length portion" that fits into the middle of the player's hand.

U.S. Pat. No. 4,438,925 to Lindstrom (1984) shows a racketball racquet handle of octagonal cross-section with a increasing circumference toward the racquet face. The ring and little fingers are to grip tightly around the narrow portion at the bottom of the handle while the forefinger and middle finger grip loosely around the wider portion at the top.

U.S. Pat. No. 4,736,950 to Doyle (1988) shows a racquet handle which, like Lindstrom's, increases in circumference toward the racquet face. Doyle's handle, which is of circular cross-section, tapers linearly from its narrowest circumference at the butt up to its widest circumference at the middle finger.

3. RADIAL ALIGNMENT OF HANDLE

U.S. Pat. No. 3,545,755 to Owada (1970) discloses a racquet with a twist in its throat which gives its handle a permanent radial alignment at a certain angle relative to the plane of the racquet face. Said alignment is not adjustable.

U.S. Pat. No. 4,183,528 to An (1980), particularly FIG. 10 thereof and the discussion at Column 6: 14–58, shows an offset racquet handle with a permanent radial alignment in addition to the offset angle.

U.S. Pat. No. 4,854,596 to Carbonetti (1989) discloses a handle which is radially adjustable during play.

4. WEIGHT IN HANDLE

U.S. Pat. No. 4,690,405 to Frolow (1987), discloses a racquet with a weight located inside its handle. This improvement to Frowlow's prior patented racquet (U.S. Pat. No. 4,165,071) was necessary because the light weight and high rigidity of Frolow's earlier invention are contrary to accepted principles of vibration reduction. The magnitude of this handle weight is only approximately 0.15 of the total weight of the racquet, and the overall weight of Frolow's racquet remains very light, approximately 330 grams. Frowlow's addition of a weight means is only for the purpose of vibration damping, not for greater power or control. Frolow's weight is located inside, and not distal to, the player's hand. This fact is not clear from Frolow's disclosure, but from his claims. In all claims relating to the weight means in his invention, whether dynamic or static, Frolow specifies that the center of gravity of the weight means is located a distance from the butt end of the handle less than 0.26 of the total length of the racquet. The center of gravity in Frolow's racquet remains close to the head, which Frolow considers to be an advantage. Col. 4: 36–41.

U.S. Pat. No. 3,941,380 to Lacoste (1976) shows a dynamic weight attached to an elastic element inside the handle for the purpose of vibration damping.

U.S. Pat. No. 4,203,596 to Nagamoto (1980) shows plates inside a racquet handle. The magnitude of this static weight is between 20 and 30 grams.

5. VIBRATION-DAMPING MEANS IN HANDLE

U.S. Pat. No. 4,690,405 to Frolow (1987), discloses a racquet with vibration damping characteristics due to a weight means located inside its handle. This improvement to Frolow's prior patented racquet (U.S. Pat. No. 4,165,072) was necessary because the light weight and high rigidity of Frolow's earlier invention are contrary to accepted principles of vibration reduction. The amount of this handle weight is relatively small in relation to the weight of the racquet, approximately 0.15 of the total weight, and the overall racquet weight of Frolow's racquet remains very light. The center of gravity of Frolow's racquet remains far away from the handle. Frolow considers this location of the center of gravity to be an advantage for vibration damping inasmuch as—according to Frowlo—"the further away the forces at the handle end from the fulcrum, the smaller these forces need to be to balance the forces being generated on the other end of the fulcrum, namely the shock and vibratory forces generated by the impact of the ball upon the racket." Col. 4: 36–41.

U.S. Pat. No. 3,941,380 to Lacoste (1976) shows a dynamic weight attached to an elastic element inside the handle for the purpose of vibration damping.

U.S. Pat. No. 4,105,205 to Theodores (1978) shows a vibration-damping fluid cavity within a racquet handle.

6. CENTER OF PERCUSSION SHIFTING MEANS

U.S. Pat. No. 4,165,071 to Frolow (1979) discloses a very light and extremely stiff racquet whose center of gravity is farther from the handle than in prior art. Frolow assumes a pivot located at the end of the handle rather than where it really is, at the hand, and claims an increase in the distance of the center of percussion from the handle due to lightening of the handle relative to the racquet face.

U.S. Pat. No. 4,355,803 to Rama (1982) shows a racquet with a moveable weight located between the hand and the racquet face.

U.S. Pat. No. 3,833,219 to Dean (1974) shows a racquet whose center of gravity is adjusted by varying the length of the racquet.

U.S. Pat. No. 4,732,384 to Seymour (1988) shows a racquet with an adjustable weight at its throat in order to broaden the "sweet spot" of the racquet by shifting the center of gravity to a point at the center of its length.

OBJECTS AND ADVANTAGES OF THE PRESENT INVENTION

1. GRIP SECURITY

The handle shape fits securely into the crook of the player's fingers and provides a broad surface for the palm and ulnar portion of the head to engage.

2. EASY GRIP SWITCHING

The alignment of this handle may be adjusted off the court to suit player preference, as for Western or Eastern grips. Both forehand, backhand, and serve grips are possible without changing the alignment of the handle during play. The ridge of the ellipsoidal flared handle is a tactile reference for precise positioning of the racquet face to hit different shots. For example, the player would place this ridge in the metacarpo-phalangeal articulation of the little finger for a forehand, and in the middle phalangeal articulation of the same finger for a backhand.

3. INCREASED POWER THROUGH LEVERAGE

The butt weight, being located at the distal extreme of the handle, imparts by the principle of leverage an additional power to heavily wristed strokes, such as the serve. The wrist snap causes the butt weight to move in a direction opposite to the direction of the racquet face, and this force is transmitted and magnified by the lever formed by the butt weight, the player's hand, and the racquet.

4. LESS IMPACT STRESS TO THE PLAYER'S ARM

The inertia of the butt weight absorbs impact forces. With the player's hand near the fulcrum, the vibrations of the lever formed by the racquet and the butt weight are imperceptible. In a conventional racquet, having its center of gravity located at a distance from the player's hand, vibrations are amplified by leverage, resulting in stress to the player's joints which may lead to or aggravate tendonitis in the elbow joint, the condition known as "tennis elbow."

5. GREATER MASS FOR GREATER POWER AND COMFORT

The overall racquet weight is increased significantly, which adds momentum to the stroke apart from the leverage principle mentioned above. For muscular players, swinging a heavy racquet would be more comfortable to the arm and shoulder than swinging a light racquet, just as throwing a baseball is easier on the arm than throwing a tennis ball. Prior art has sought to reduce rather than to balance out the weight of the racquet head, and this weight reduction has reduced the potential momentum of the racquet. One means of increasing momentum and thus producing greater power is to increase the mass of the racquet in the proper location.

6. RACQUET HEAD CONTROL

The butt weight of the present invention shifts the center of gravity of the racquet to a point near the hand, thus decreasing the strain on the player's wrist and forearm muscles from holding up the weight of the racquet head. The head weight is balanced out by the butt weight. The apparently lighter racquet head thus becomes easier to position during fast exchanges at the net.

7. EXTENDED CENTER OF PERCUSSION

The addition of weight at the butt moves the center of percussion farther from the handle and locates the desired impact area near the center of the string mesh. Increased power and control come to the player's strokes, especially heavily wristed strokes such as the serve. The extended center of percussion gives the racquet a larger "sweet spot" where impacts feel comfortable.

DRAWING FIGURES

REFERENCE NUMERALS IN DRAWINGS

10—throat section
12—butt section
14—end of handle
16—point at which circumference begins to increase
18—point of greatest circumference
20—point of least circumference, juncture of throat and butt sections.
22—end of butt section, without weight
24—ridged edge of butt section, formed by increase in long ellipsoid axis
26—distal butt weight
28—sixteen-pointed star-shaped cavity
30—plug with 16 triangular splines
34—cylindrical plug
**36*a***—cogged ring on throat section
**36*b***—cogged ring on butt section
38—groove
40—cog
44—racquet face
46—octagonal cavity
48-edge of flange
50—flange
54—boss

DETAILED DESCRIPTION OF THE PREFERRED EMBODIMENT

Figure 1:
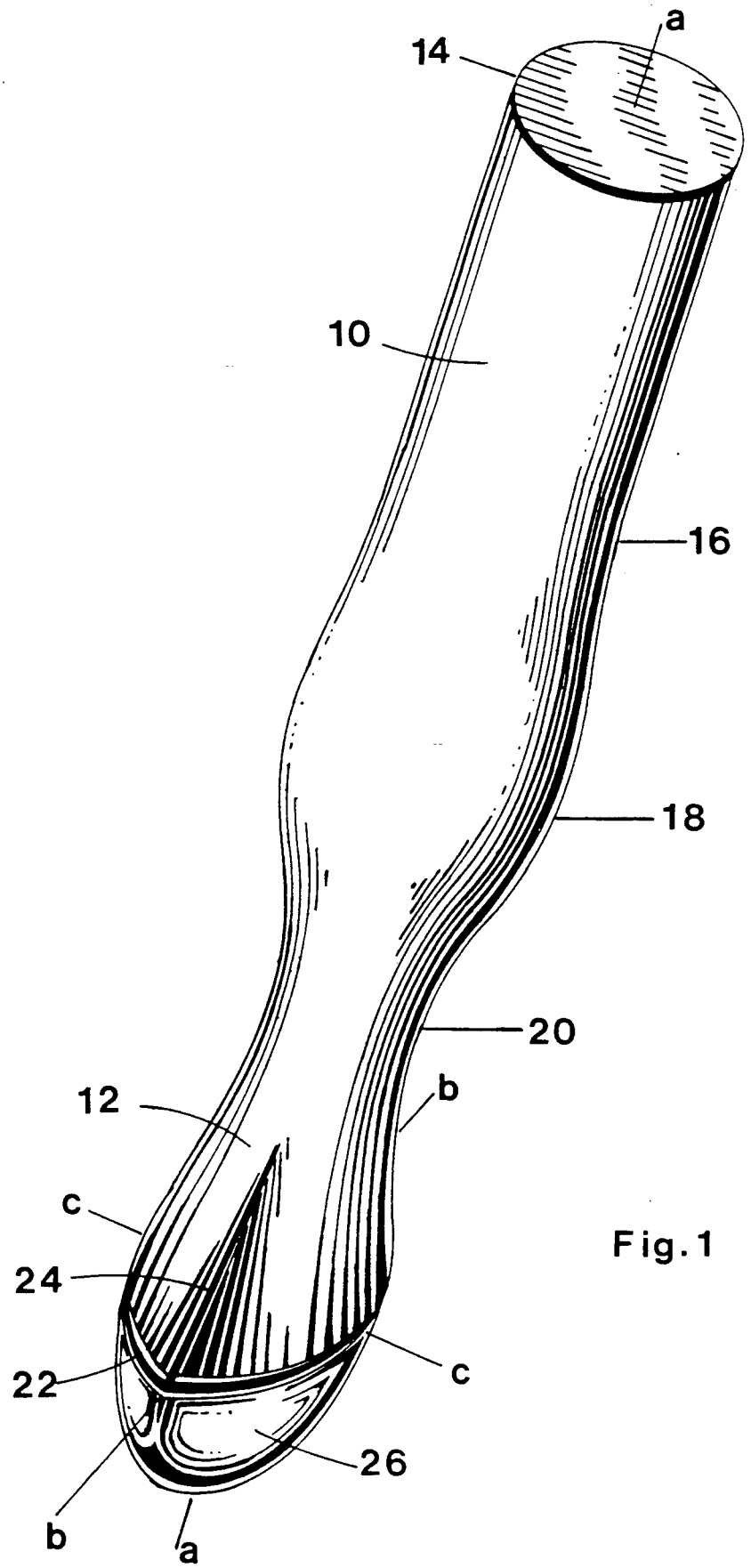
FIG. 1 shows the handle with its weighted butt.

FIG. 1 is a view of the handle described in this application, which may be composed of polyvinyl chloride, graphite composite around a foam core, wood, or material of equivalent tensile strength. Said handle attaches to the racquet throat at (14), and the remainder of the racquet, including the planar striking surface, or racquet face, attaches to the racquet throat by conventional means. Said handle may be manufactured in one piece or it may comprise two sections: a throat section (10) and a butt section (12). The total length of said handle is approximately 20 centimeters (cm).

The throat section (10) is approximately 15 cm. in length and has a uniform circular cross-section extending to (16), a distance approximately 6.6 cm from (14), with a circumference of approximately 9.75 cm. From (16) to (18), the cross-section remains circular and the circumference increases as a curvilinear function of the distance from (16) to a maximum value of approximately 12 cm at (18), at approximately 11.2 cm from (14). The circumference of the circular cross-section then decreases curvilinearly from the maximum value at (18) to a minimum value of approximately 6.3 cm at (20).

The butt section (12) begins at (20) and, when the handle comprises two pieces, engages with the throat section (10) at (20) by adjustable form-locking means, one embodiment of which is discussed below. The butt section (12) begins with a circular cross-section with a circumference of approximately 6.3 cm at (20), then assumes an ellipsoidal cross-section, whose major axis (b—b) is bisected by the longitudinal axis (a—a) and has a dimension which increases as a curvilinear function of the distance from (20) along the longitudinal axis (a—a). At a point approximately 2 cm from (20), the ellipsoidal cross-section becomes ogive on both ends of the (b—b) axis so as to form ridged edge (24) along the butt section (12) until its end (22). At (22) the dimension along the (b—b) axis of the ellipsoidal cross-section is approximately 6.5 cm. The minor axis (c—c) of the ellipsoidal cross-section is bisected by the longitudinal axis (a—a) and by the long axis (b—b), and its dimension increases as a curvilinear function of distance along the longitudinal axis (a—a) from (20), becoming approximately 3.2 cm at (22).

A metal weight (26) of approximately 200 grams is attached to the end of the handle at (22) by suitable means. Said metal weight where it joins the handle conforms to the shape of the butt end of the handle, and it is of a weight sufficient to locate the center of gravity of the racquet at a point which is a distance from the butt end (22) less than one-third of the total dimension of the racquet along its longitudinal axis (a—a), that is, less than approximately 23 cm from (22).

Figure 2:
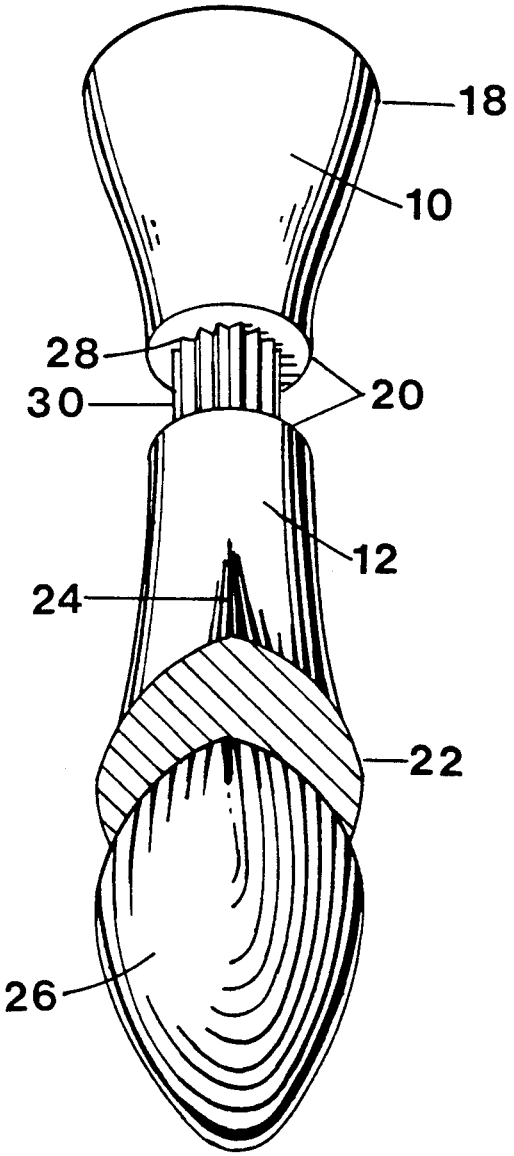
FIG. 2 shows an adjustable embodiment of this handle, comprising two sections connected together by a ridged plug.

FIG. 2 shows the preferred means of connection when the handle is fabricated in two sections, the throat section (10) separate from the butt section (12), so as to make a butt section (12) whose longer cross-sectional axis (b—b) is adjustable in its angle relative to the plane of the racquet face. A sixteen-pointed star-shaped cavity (28) in the throat section (10) engages with a plug (30) having sixteen triangular splines, forming a connection that prevents movement at (20) normal to and radial to the longitudinal axis of the handle (a—a). Said plug (30) may be integral to or inserted in a cavity in the butt section (12). Suitable means, such as glue or adhesive tape around the junction of the butt and throat sections (10, 12) at (20), prevent movement along the longitudinal (a—a) axis.

Figure 3:
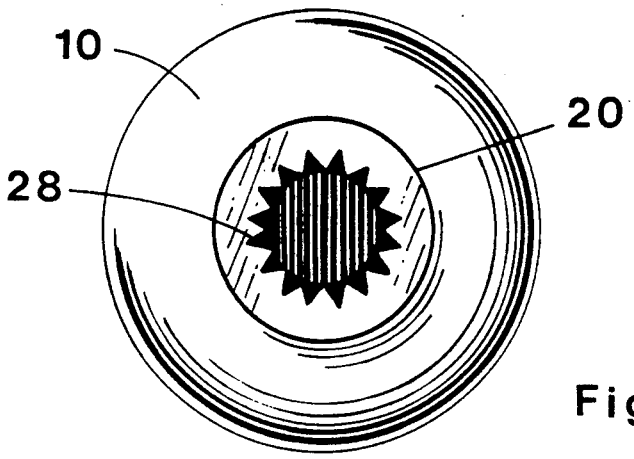
FIG. 3 shows an end view of the throat section of the adjustable embodiment of this handle.

FIG. 3 shows an end view of the throat section (10) showing the sixteen-pointed star-shaped cavity (28), which is approximately 4 centimeters deep. The sixteen triangular splines of the plug of the butt section (not shown in this figure) fit snugly into the space of said cavity, as described in FIG. 2.

Figure 4:
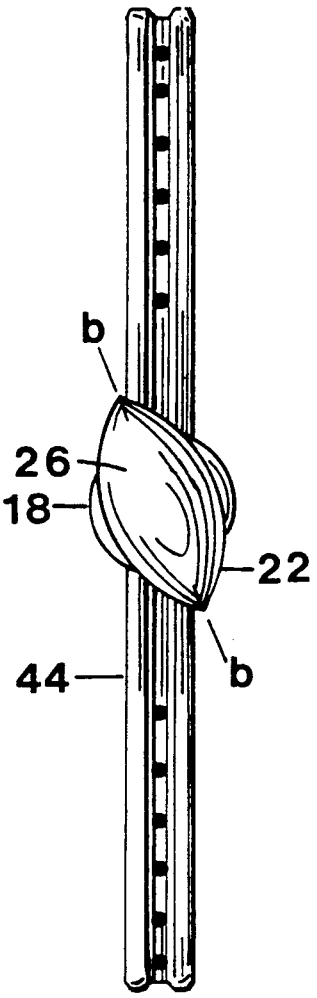
FIG. 4 shows an end view of the butt end of the handle, comprising a butt weight.

FIG. 4 shows an end view of a racquet comprising this handle. The butt weight (26) attaches by suitable means to the end of the handle (22), such that said weight is outside of the player's hand when the handle is gripped for play. The ellipsoidal long axis (b—b) is aligned at a 22.5 degree angle relative to the racquet face (44) in this drawing, but the angle of the (b—b) axis relative to the plane of the racquet face (44) may be adjusted in increments of 22.5 degrees by the means described in FIGS. 2 and 3.

Figure 5:
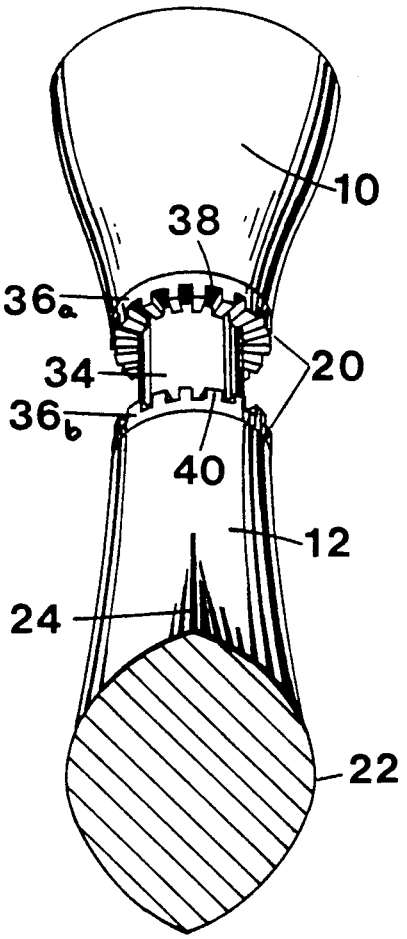
FIG. 5 shows an alternate adjustable embodiment of this handle, comprising two sections connected together.

FIG. 5 shows an alternative to the preferred embodiment of the adjustable handle as shown in FIGS. 2 and 3. A cylindrical plug (34), either integral to or attached by suitable means to the butt section (12), fits snugly in a cylindrical cavity approximately 4 cm deep in the throat section (10). Two matching rings (36*a*, 36*b*), each having an inner diameter of the same dimension as the diameter of the plug (34), an outer diameter of the same dimension as the diameter of the handle at (20), and a thickness of approximately 3 mm, are attached securely by suitable means to the ends of the butt and throat sections. Said rings may be made of metal, plastic, or other suitable material. Sixteen grooves (38) are cut along radial lines and evenly spaced at 11.25 degree intervals around each ring. Each groove has a circumferential extent of 11.25 degrees and a 1.5 mm depth, thus forming cogs (40) in the intervals. The cogs (40) in each ring engage the grooves (38) in the opposite ring. Suitable means, such as glue or adhesive tape, prevent movement along the (a—a) axis.

Figure 6:
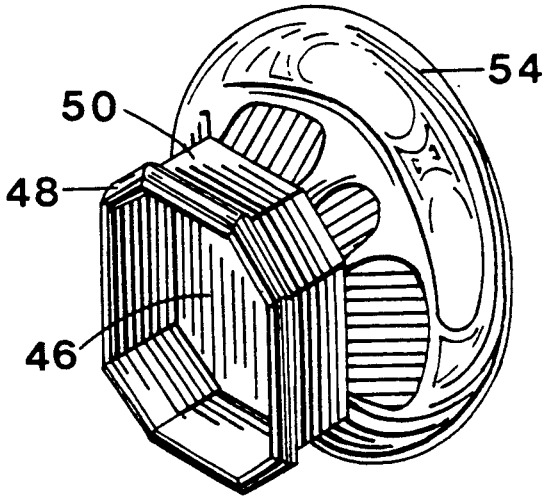
FIG. 6 shows a weighted butt cap which may be fitted to conventional octagonal racquet handles.

FIG. 6 shows an alternative to the preferred embodiment of the weighted butt disclosed in this invention. FIG. 6 shows a weighted butt cap which may be fitted to conventional octagonal racquet handles by means of an octagonal cavity (46) therein. A boss (54) projects below the hand of the player when the racquet is held for play. A flange (50) integral to the boss (54) surrounds the cavity (46), ending at a blunt edge (48). Suitable means, such as glue or adhesive tape, connect said weight to the conventional octagonal handle.

The foregoing description contains dimensions as to racquet size, handle length, and grip measurements thich are intended to represent average measurements to suit the average tennis player. The dimensions of the handle cited in this invention may be varied to suit other players and their preferences without in any way altering the nature of this embodiment. Other embodiments, for example for racquetball or squash racquets, are also possible. The foregoing preferred embodiments are not in limitation of any of the claims asserted herein.

OPERATION, RAMIFICATIONS, AND SCOPE

The weighted, ellipsoidal flared handle described here is particularly useful for tennis racquets. It may also be used for racquetball or squash racquets. The unique shape of the butt section conforms to the anatomy of the human hand better than the conventional octagonal shape or any prior art. In the fast and violent action of expert tennis, the ellipsoidal flared shape allows for firmer, more secure gripping of the racquet. Also, it allows for easier switching from from forehand to backhand, as the alignment depends only upon which joint of the little finger contacts the ridged edge of the butt section.. The orientation of the long axis (b—b) of the ellipsoidal cross-section to the plane of the racquet face may be changed by suitable means, such as the plug and socket connection described in FIGS. 2 and 3, so as to accommodate individual preferences as to grip style.

If a connection between separate throat and butt sections were located further toward the racquet face, instead of approximately at the middle finger of the hand, the connection between the butt and throat sections might fail from material fatigue over time.

Vibration is absorbed by the plug and cavity joint between the butt and throat sections before it can be transmitted to the bony structure of the ulnar part of the hand, and thence to the elbow. Also, the distal butt weight absorbs the reactive force from ball impacts on the racquet face. These two vibration-damping components act as shock sinks, so that only a portion of impact forces are absorbed by the player's hand and arm.

The small circumference of the grip at the middle finger gives greater strength to the grip of this finger, as it is less extended while gripping the racquet. The increase of the circumference of the handle outward toward the racquet face gives increased control. The broad surface for the forefinger and thumb to engage permits more precise alignment of the racquet head than do conventional racquets. Players may carve notches in this surface to aid in precise hand positioning.

A distal butt weight adds power to the stroke by leverage and extends the center of percussion of the racquet. This increases the feeling of control over the racquet, and its power. Assuming a standard 368 gram racquet which is a standard 68.58 cm long, with a center of rotation at an axis through (20) in FIG. 1 and perpendicular to the longitudinal axis (a—a), a distal butt weight (26) of 200 grams will shift the center of gravity from approximately 33 cm from the end of the butt (22) to approximately 21 cm from (22). The center of percussion of such a weighted racquet will extend along the (a—a) axis a distance of approximately 6 cm further toward the center of the racquet face than its location without the distal weight, in fact coinciding with the center of the stringed mesh. Instead of being located approximately 47 cm from (22), the center of percussion will be approximately 53 cm from (22).

The butt weight adds momentum to the racquet face when the player serves. The body, arm, and racquet assembly striking the ball has more total mass, therefore momentum increases even though racquet speed may stay the same. Moreover, the location of this weight at the butt end of the racquet imparts additional force to the racquet face by leverage when the wrist is snapped. The butt weight moves in a direction opposite to the movement of the racquet face, and the force of the butt weight is transmitted and magnified along the lever formed by the racquet, with the player's hand as fulcrum.

The weighted butt shifts the center of gravity to a location close to the hand of the player. Thereby, the cantilevered effect of the racquet held up by the muscles of the player's wrist and forearm is ameliorated. Assuming a standard 368 gram racquet which is a standard 68.58 cm in length, with a center of rotation at an axis through (20) in FIG. 1 and perpendicular to the longitudinal axis (a—a), a distal butt weight (26) of 200 grams will shift the center of gravity from approximately 33 cm from the end of the butt (22) to approximately 21 cm from (22). Thereby, the strain on the player's wrist and forearm is reduced and the racquet face becomes easier to position during fast play. The overall weight of the racquet is increased by the butt weight, but its distal location ameliorates rather than aggravates the strain on the player's wrist and forearm. The only muscles strained by this additional weight are the strong muscles of the upper arm and shoulder.

A heavy butt cap which can be fitted to a conventional octagonal racquet handle by suitable means such as adhesive tape or glue is one ramification of the present invention. FIG. 6 describes one such butt cap. The numerous aforementioned advantages of the handle shape of the present invention would optimize the effect of the weighted butt principle disclosed herein. A weight with a long ellipsoidal axis, as shown in FIG. 4, is more stable in its swing along that axis than a round one would be.

A ramification of the handle shape disclosed in the present invention is a means whereby the orientation of the ellipsoidal long axis (b—b) relative to the plane of the racquet face may be adjusted so as to suit player preference. This ramification is described in FIGS. 2, 3, and 4. Some players are left-handed, some players have hands that are larger or smaller than the norm, and some players prefer a grip that aligns the racquet face parallel rather than perpendicular to the ground. An adjustable handle would accommodate all of these individual differences among players. Another alternative to accomplish the same objective is to manufacture, for example, six different (b—b) axis alignments for racquets. Most players should prefer the alignment shown in FIG. 4, as it suits both right-handers playing with a so-called Eastern grip, i.e. a hand position on the racquet handle which aligns the racquet face perpendicular to the ground, and left-handers playing with a so-called Western grip, i.e. a hand position on the racquet handle which aligns the racquet face parallel to the ground.

COMPUTATIONS FOR CENTER OF PERCUSSION

The so-called "sweet spot" is the center of percussion of a racquet. This center of percussion is the point through which the action line of the resultant of the body forces of the racquet material acts when rotating about an axis. When this action line is co-linear with the external impact force of a ball striking the string mesh of the racquet, there is no reactive force at the axis of rotation and the reaction of the body forces to the impact force is maximized.

The center of percussion should be located away from the axis of rotation to maximize torque and power consistent with the elastic rebound action of the string mesh. Since this rebound string action is at its maximum in the fundamental mode at the center of the string mesh, then ideally the optimum location of the center of percussion would be at the center of the racquet face.

The addition of a brass distal butt weight of 7 ounces (198.45 grams) to a racquet of conventional length (27 inches) and weight (13 ounces) results in a significant shift of the center of percussion a distance of 6.35 cm along the longitudinal axis of the racquet toward the tip of the face and to the center of the string mesh, when the axis of rotation (o—o) in the plane of the racquet face and perpendicular to the longitudinal axis of the handle is located a distance of approximately 5 cm (2 inches) from the butt end. Said center of percussion then coincides with the center of the string mesh. In addition, the racquet's center of gravity is shifted a distance of approximately 11.89 cm (4.68 inches) closer to the butt end.

A. Center of Gravity

A tennis racquet which is 27 inches long, and weighs 13 ounces, will normally have a center of gravity located approximately 13 inches from its butt end, or a distance r approximately 11 inches from its center of rotation during play, the axis o—o, which is 2 inches from the butt end. The racquet weight is distributed more or less uniformly at 0.447 oz./in. over the 14 inch extent of face and throat and at 0.518 oz./in. over the 13 inch extent of the remainder of the throat and handle.

The addition of a brass 7 oz. (198.45 gram) weight extending beyond the butt end in a more or less uniform distribution a distance of 0.764 inches (1.94 cm) changes the distance r from the axis of rotation o—o from 11 inches to 6.32 inches, determined as follows:

Taking first moments about the axis o—o, the total weight times its lever arm r is equal to the weight of the 14-inch racquet face portion ($0.447\times14$ oz.) times its lever arm ($11+14/2$ inches) plus the weight of the 11-inch throat and handle portion on the face side of the axis of rotation ($0.518\times11$ oz.) times its lever arm (11/2 inches), minus the weight of the handle portion on the butt side of axis o—o ($0.518\times2$ oz.) times its lever arm (2/2 inches) minus the 7 oz. weight times its lever arm ($2+0.764/2$ inches). The foregoing equality may be solved for r to yield $r=6.32$ inches (16.05 cm) from o—o and 8.32 inches (21.13 cm) from the butt end.

Since the center of gravity without the 7 oz. weight at the butt end is 11 inches (27.94 cm) from o—o and 13 inches (33.02 cm) from the butt end, the center of gravity is shifted by the 7 oz. weight a distance toward the butt end of 11 minus 6.32 inches, i.e. 4.68 inches (11.89 cm.).

B. Center of Percussion (1) WITHOUT BUTT WEIGHT

The distance q from the axis of rotation o—o to the center of percussion of the racquet can be determined from the formula:

$$q = \frac{k^2_{o-o}}{r}$$

where $k_{o-o}$ is the radius of gyration fo the mass of the racquet about the axis o—o and r is the distance from the axis o—o to the center of gravity.

The radius of gyration $k_{o-o}$ is determined by taking moments of inertia (second moments) about the axis o—o. The total weight, 13 ounces (198.45 grams) times $k^2_{o-o}$ is equated to the sums of all elemental weights of elemental slices cut by planes cut perpendicular to the longitudinal axis times the square of the distance of each of said slices from the axis o—o. For the weight distribution of a conventional racquet, these sums amount to 2361.45 oz.-in.$^2$, so that $k^2_{o-o}$ is 181.65. Since r is 11 inches as determined in the foregoing discussion of center of gravity, q is 16.5 inches (42 cm) from the axis o—o. The distance to the center of percussion from the butt end, using the axis o—o as the axis of rotation, is 16.5 inches plus 2 inches, i.e. 18.5 inches (47 cm).

(2) WITH BUTT WEIGHT

The addition of a brass 7 ounce (198.45 gram) butt weight at the distal extreme of the racquet handle, with the weight uniformly distributed along its length of 0.764 inches (1.94 cm) moves the center of percussion toward the center of the racquet face, determined in quantity as follows:

The total racquet weight of 20 ounces ($13+7$), times the changed radius of gyration due to adding the butt weight is equatted to the sums of all elemental weights times the squares of their distances from the axis o—o plus the sums of all elemental parts of the butt weight formed by planes cutting perpendicular to the longitudinal axis times the square of the distance of each of said points to the axis o—o. The sum of all elemental second moments is, therefore, 2361.45 oz.-in.$^2$ for the racquet face, throat, and handle plus 40.04 oz.-in.$^2$ for the butt weight, totalling 2401.49 oz.-in.$^2$. The changed radius of gyration squared is then 120.07, determined by dividing 2401.49 oz.-in.$^2$ by the total weight 20 oz.

Since the distance r from the axis o—o to the center of gravity of the butt-weighted racquet is 6.32 inches (as determined by the foregoing discussion on center of gravity), the distance q from the axis o—o to the center of percussion of the butt-weighted racquet is 120.07 divided by 6.32, i.e. 19 inches (48.26 cm).

Without the butt weight, the racquet has a center of percussion that is 16.5 inches (42 cm) from the axis o—o, so that the 7 ounce weight added to the butt of the racquet has shifted the center of percussion 19 minus 16.5 inches, i.e. 2.5 inches (6.35 cm) toward the tip of the racquet face. That shift places the center of percussion at the center of the string mesh.

I claim:

1. An improved tennis racquet, comprising a face defining a generally planar striking surface for striking a ball and a handle for engaging the striking hand of a player, one end of the handle being attached to the face and the other end being the distal end, and having a longitudinal axis extending along the centerlines of the face and the length of the handle, wherein the handle comprises ellipsoidal cross sections with coplanar ellipsoidal major axes decreasing as a function of distance along the longitudinal axis from said distal end to a point less than 6 cm from said distal end, at approximately where the middle finger and center of the palm of the striking hand of a player is located when the racquet is gripped normally with one hand for striking a ball, at which point the dimension of the major axis equals the dimension of the minor axis of the cross section of the handle, and the circumference of the handle is at its minimum.

2. The racquet of claim 1, further comprising approximately circular cross-sections increasing in circumference as a function of distance along the longitudinal axis toward the face from said point.

3. The racquet of claim 1, further including suitable means for adjusting the angle of the plane of said coplanar ellipsoidal major axes relative to the plane of the face.

4. The handle of claim 1, further including bilateral ogival ridges bisected by the plane of said coplanar ellipsoidal major axes.

5. An improved tennis racquet, comprising (a) a face defining a generally planar striking surface, (b) a handle for engaging the striking hand of a player, and (c) a static butt weight in excess of 100 grams attached to the end of the handle which is distal to the face, said static butt weight protruding axially beyond the handle such that said striking hand is between said static butt weight and the face, whereby the center of percussion of the racquet is extended away from the handle, the striking force of the face is increased, impact and vibration forces transmitted through said striking hand are decreased, and strain on the wrist and forearm muscles of the player due to holding the racquet as a cantilever is decreased.

6. The improved racquet of claim 5 wherein said static butt weight is attached to a handle comprising ellipsoidal cross-sections.

7. The improved racquet of claim 5 wherein said static butt weight is attached to a conventional, octagonal handle.

8. A tennis racquet, comprising a face defining a generally planar striking surface for striking a ball and a handle for engaging the striking hand of a player, one end of the handle being attached to the face and the other end being the distal end, and having a longitudinal axis extending along the centerlines of the face and the length of the handle, wherein the handle comprises:

(a) a throat section permanently attached to the face, (b) a butt section separable from the throat section by movement along the longitudinal axis, (c) adjustable form-locking means for preventing axial rotation of said butt section around the longitudinal axis and for fixing the radial alignment of said butt section with reference to the face when the butt section is engaged with the throat section, and (d) suitable means for preventing longitudinal movement of the butt section when it is engaged with the throat section, whereby shocks which might have been transmitted from the face through the handle to the arm of the player are reduced, and whereby a player using the racquet may adjust the alignment of the butt section relative to the angle of the face.

9. The racquet of claim 8, wherein said butt section comprises ellipsoidal cross-sections.

10. The racquet of claim 8, further including a static butt weight in excess of 100 grams protruding axially beyond the distal end of the handle.

* * * * *